United States Patent [19]

Gaspar

[11] 4,057,244

[45] Nov. 8, 1977

[54] CHILD'S PLAY SEAT APPARATUS

[76] Inventor: Phyllis L. Gaspar, 6522 S. Erie, Tulsa, Okla. 74136

[21] Appl. No.: 558,139

[22] Filed: Mar. 13, 1975

[51] Int. Cl.[2] ..... A47B 39/12; A47B 83/02

[52] U.S. Cl. ..... 272/1 A; 35/8 R; 35/60; 46/41; 46/91; 108/25; 272/1 B; 297/156

[58] Field of Search ..... 35/60, 8 R; 272/1 R, 272/1 A, 1 B; 312/126, 127, 228, 231, 235 R, 235 A, 237, 236; 297/135, 172, 174, 156, 157, 188; 108/25; 46/15, 41, 91; D34/15 AC; D6/6, 17, 42, 44

[56] References Cited

U.S. PATENT DOCUMENTS

| | | | |
|---|---|---|---|
| D. 97,086 | 10/1935 | Mintz | D6/42 |
| 115,349 | 5/1871 | Palm | 35/60 |
| D. 119,253 | 3/1940 | Balleydier | D6/42 |
| 232,599 | 9/1880 | Crandall | 35/60 |
| 339,741 | 4/1886 | Clough | 35/60 |
| 464,521 | 12/1891 | Posz | 312/228 X |
| 494,191 | 3/1893 | De La Porte | 108/25 X |
| 1,018,373 | 2/1912 | Robbins | 35/60 |
| 1,354,240 | 9/1920 | Buraky | 312/236 X |
| 1,409,330 | 3/1922 | Aper | 312/228 |
| 1,511,211 | 10/1924 | Baublitz | 46/41 |
| 2,215,657 | 9/1940 | Anderson | 297/156 X |
| 2,515,171 | 7/1950 | Abel | 46/41 |
| 3,106,394 | 10/1963 | Gelbart | 46/91 X |
| 3,213,565 | 10/1965 | Grosz | 46/91 |
| 3,577,675 | 5/1971 | Kohner | 46/41 |

FOREIGN PATENT DOCUMENTS

| | | | |
|---|---|---|---|
| 422,107 | 1/1911 | France | 312/228 |
| 10,977 | 9/1880 | Germany | 297/174 |
| 227,045 | 2/1910 | Germany | 312/228 |

OTHER PUBLICATIONS

Montgomery Ward, 1963, Fall and Winter Catalog, p. 830, Dishpan.

*Primary Examiner*—Richard C. Pinkham
*Assistant Examiner*—Arnold W. Kramer
*Attorney, Agent, or Firm*—Head, Johnson & Chafin

[57] ABSTRACT

A child's play seat comprising a support frame structure having a play area including an open box member having an upstanding wall secured thereto and a relatively deep removable open tray disposed in the box, and a seat member secured to the frame structure for supporting the child while using the play area. A plurality of amusement devices are secured to the upright wall or backboard and communicate with the tray and cooperate therewith for entertaining the user of the apparatus. A hinged cover is provided for the box-type play area, said cover having one position for covering the open end of the tray and another position providing access to the interior of the tray.

6 Claims, 6 Drawing Figures

CHILD'S PLAY SEAT APPARATUS

BACKGROUND OF THE INVENTION

1. Field of the Invention

This invention relates to improvements in children's play devices and more particularly, but not by way of limitation, to a child's play seat.

2. Description of the Prior Art

Children frequently enjoy playing with water, sand, clay, and the like, and may spend many hours engaged in such activities in the out-of-doors. These elements are adaptable to many types of activities in that the fluid nature of the water and sand can be "harnessed" for producing interesting pastimes. However, during inclimate periods, or in evening hours when it may be too dark outside to conveniently play, the child may desire to engage in activities involving these elements in the house, or the like. The fluid and "messy" nature of these products combined with a child's exuberance may lead to disadvantages when the child is engaged in such activities indoors. In addition, a child's attention span may be relatively short, and after a short period of time, his desire may change from playing with water, sand, clay, and the like. Here again, much clutter and damage may occur from a child's handiwork if the amusement is not directed in such a manner that a proper work or play space is provided.

SUMMARY OF THE INVENTION

The present invention contemplates a novel child's play seat which comprises a support frame structure having a box-type play area and a seat secured to an arm extending outwardly from the frame in a convenient location for supporting the child from the frame in a convenient location for supporting the child while he is using the apparatus. A removable tray is included in the box-type play area and cooperates with an upstanding wall or backboard having a plurality of amusement devices secured thereon to provide many hours of amusement or pastime activities for a child, or other person. In addition, a cover member may be hingedly secured to the box-type play area in order that the open end of the tray may be periodically covered to prevent unwanted access to the interior thereof, and to provide a substantially flat surface for affording a play area for many types of entertainment for the child in addition to use of the tray playing area. The tray is of a sufficient depth for holding water, sand, and the like, in a manner substantially precluding accidental spilling of the contents. The amusement devices on the backboard are compatible with the water or sand for activation by the water or sand and return the water or sand to the interior of the tray. The support frame structure preferably comprises a pair of wall members spaced apart by at least one shelf member which may be used for storage of the child's toys, books, or the like, when not in use. The novel child's play seat is simple and efficient in operation and economical and durable in construction.

DESCRIPTION OF THE PREFERRED EMBODIMENT

Figure 1:
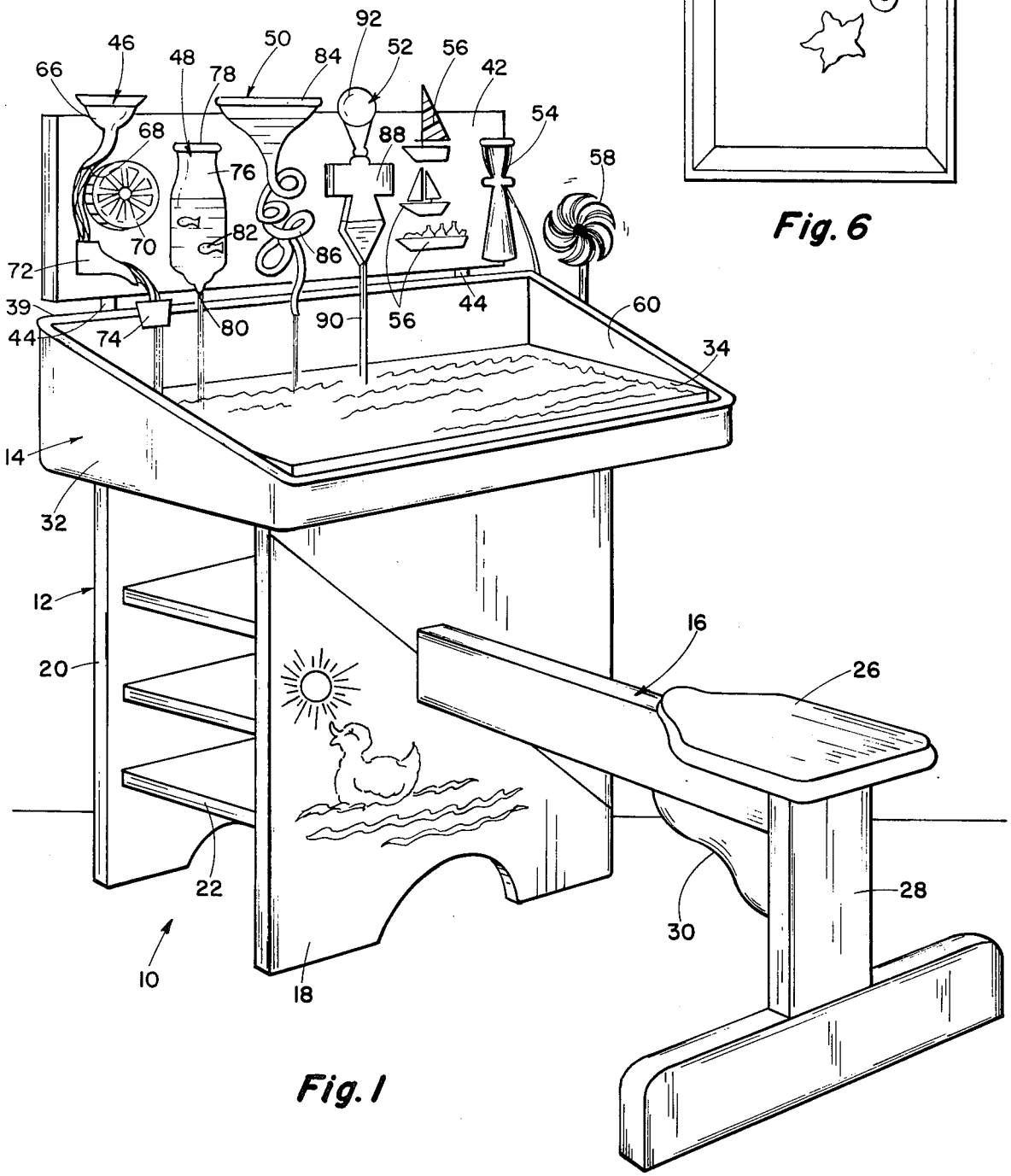
FIG. 1 is a perspective view of a child's play seat embodying the invention.
Figure 3:
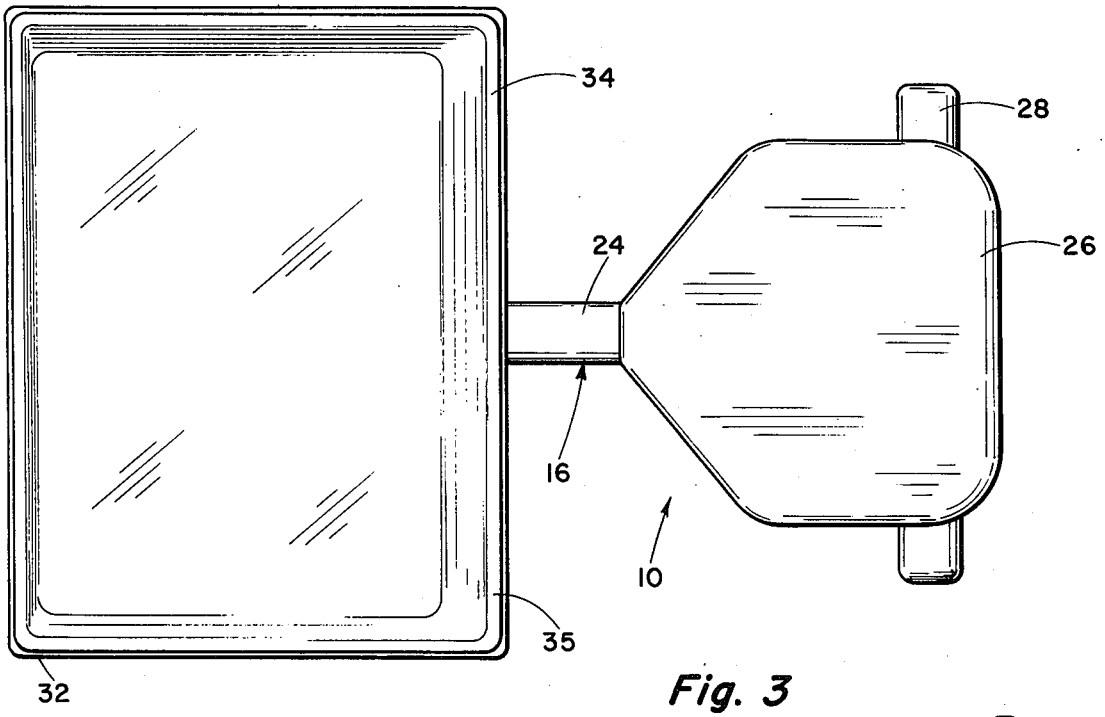
FIG. 3 is a view taken on line 3—3 of FIG. 2.
Figure 2:
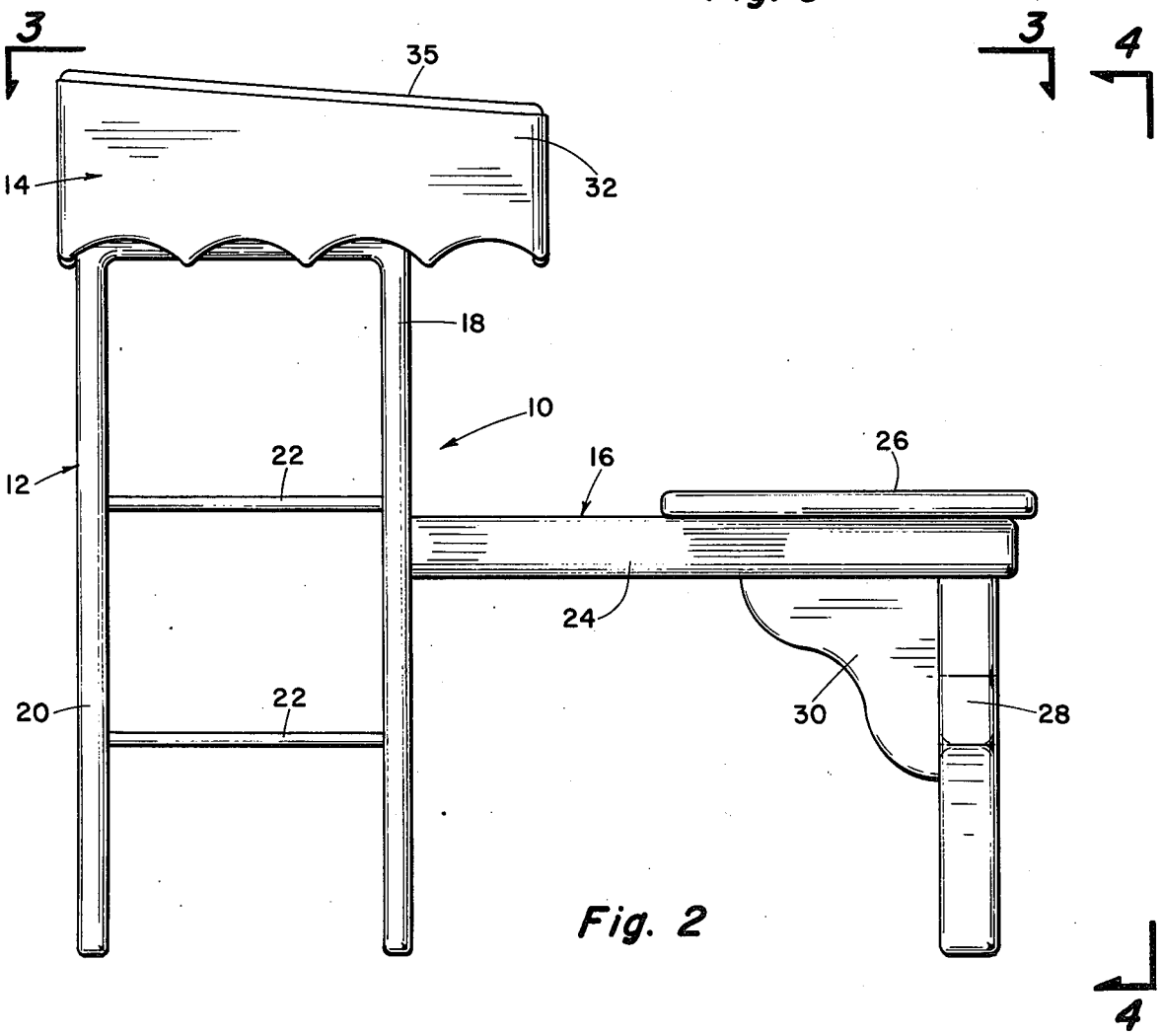
FIG. 2 is a side elevational view of a child's play seat embodying the invention, with portions thereof eliminated for purposes of illustration.

Referring to the drawings in detail, reference character 10 generally indicates a child's play seat comprising a support frame structure 12 having a box-type play area 14 supported at the upper end thereof and a straddle type seat assembly 16 extending outwardly therefrom for supporting a child (not shown) while using the apparatus 10. The support frame structure 12 may be of any suitable configuration, but as depicted herein comprises a pair of upstanding wall members 18 and 20 spaced apart by a plurality of spaced shelf members 22 (FIG. 1).

A support arm 24 has one end secured to the outer surface of the wall 18 in any suitable manner and extends substantially perpendicularly outwardly therefrom for supporting a seat member 26 in the proximity of the opposite end thereof. It is preferable to provide a vertical leg member 28 at the outer end of the leg 24, preferably disposed beneath a portion of the seat 26, for supporting the seat 26 and leg 24 from the ground or floor for stability. In addition, a suitable gusset member 30 may be suitably secured between the leg 28 and support arm 24 beneath the seat 26, if desired, for strength. Of course, it will be apparent that the arm 24 may be cantilevered outwardly from the wall 18 for supporting the seat 26, if desired.

Figure 4:
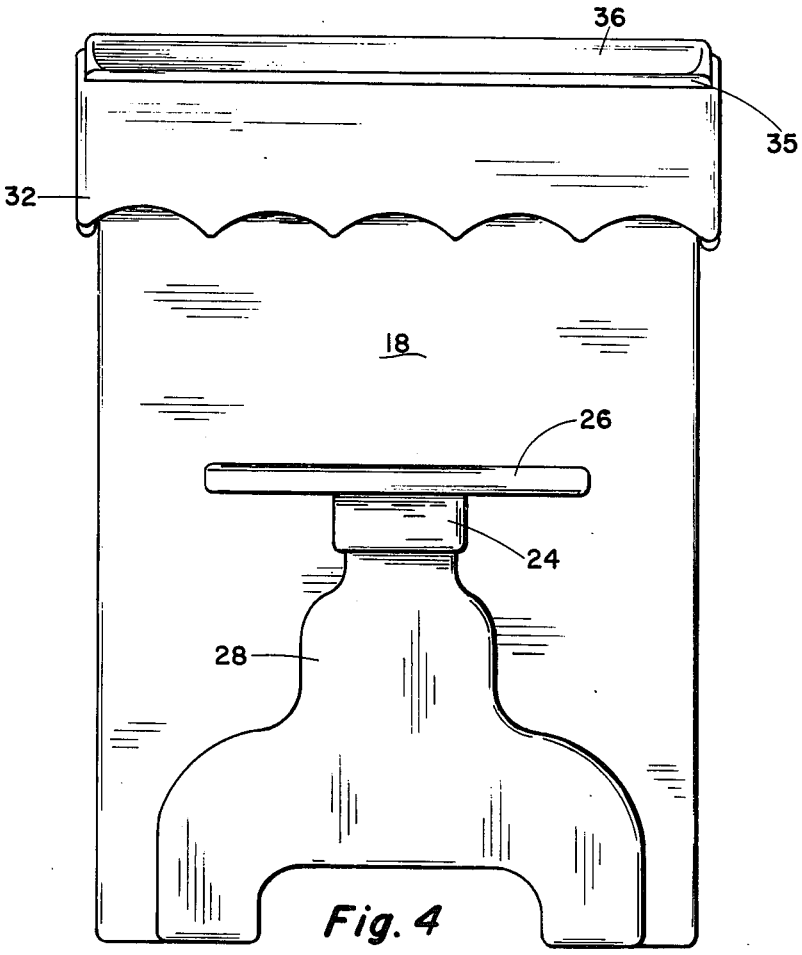
FIG. 4 is a view taken on line 4—4 of FIG. 2.

The box-type play area 14 as shown herein comprises an outer substantially rectangular framework 32 secured to the upper end of the frame 12 in any suitable manner, and provided with a central opening for receiving a tray 34 which may be removably disposed therein. The outer rim 35 of the tray 34 may be supported by the rectangular frame 32. The tray 34 is preferably of a suffient depth for containing a quantity of water, sand, or the like, and is preferably constructed from a molded plastic, or the like, which is leakproof. It is preferable to provide a cover member 36 for the open upper end of the tray 34. The cover 36 may be completely independent of the support frame 12, and may be selectively placed on the tray 34 for precluding access to the interior thereof and is preferably of a substantially flat configuraton to provide a flat surface for the child's use. However, as shown herein, it is preferable to secure one edge, such as the rear edge 38 thereof, to the corresponding rear edge 39 of the rectangular frame 32 by suitable hinge means 40. In this manner, the cover 36 will be an integral part of the apparatus 10 for substantially eliminating accidental loss thereof, and may be moved to alternate open positions as shown in broken lines in FIG. 5, and closed positions, as shown in solid lines in FIG. 4.

An upright wall or backboard 42 is secured to the rear edge 39 of the box 14 in any suitable manner, as for example, the backboard 42 may be removably secured to the edge 39 by suitable bracket members 44 whereby the backboard 42 will not interfere with the cover 36 and hinge means 40, and may be removed from the box 14 when the cover 36 is to be closed against the open end of the tray 34. (It is to be noted that the cover 36 may also be utilized for closing the open end of the box 14 when the tray 34 is removed therefrom if desired.) A plurality of amusement devices 46, 48, 50 and 52 are secured to the backboard 42 in any suitable manner, either removable therefrom or rigidly secured thereto, as desired, for cooperation with the tray 34 to afford amusement for the user of the device 10 as will be hereinafter set forth. In addition, a telescope 54 may be removably secured to the box 14, or backboard 42, as desired, for use by the user of the apparatus, and a plurality of boats 56 or the like, may be removably stored on the backboard 42 for use in the water in the tray 34, as will be hereinafter set forth. A rotor member or fan 58 having soft rubber or plastic fan blades may be mounted on one side 60 of the box 14 and operably connected with a suitable power source, such as a motor (not shown) for selectively creating air movement across the length of the open end of the tray 34 for a purpose as will be hereinafter set forth.

Figure 6:
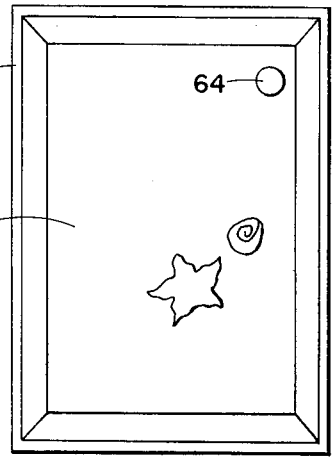
FIG. 6 is a top perspective view of a removable tray such as may be used in the invention.

As will be particularly seen in FIG. 6, the bottom 62 of the tray 34 is provided with a drain opening having a plug member 64 removably disposed therein. When the plug member 64 is inserted within the drain opening water, sand, or the like, may be contained within the tray 34. Conversely, when the plug 64 is removed from the drain opening, the contents of the tray 34 may be emptied therefrom. Of course, it may be desirable to eliminate the drain opening and plug, and merely manually remove the tray 34 from the box 14 in order to remove the contents from the tray.

In use, the child (not shown) may sit on the seat 26 and draw, color, play with other toys (not shown) which require the use of a flat surface when the cover 36 is in the closed position. In addition, the cover 36 precludes access to the interior of the tray 34 when in the closed position, and thus protects the contents of the tray from unwanted tampering.

Figure 5:
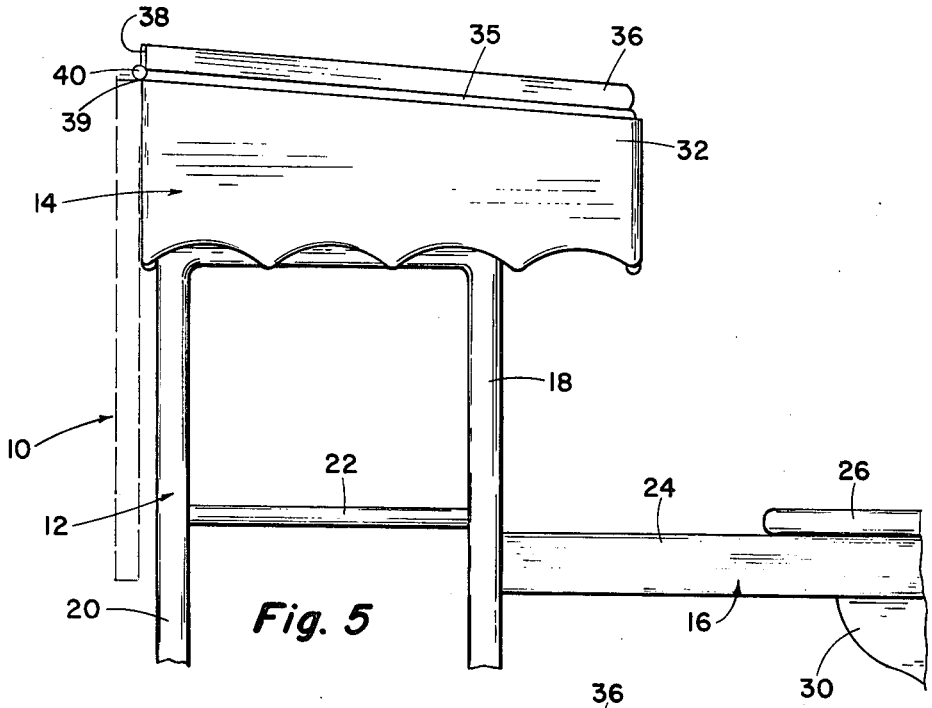
FIG. 5 is a broken side elevational view similar to FIG. 2 and illustrating a hinged cover member thereon, with one position of the cover being depicted in solid lines and another position thereof being depicted in broken lines.

When the cover 36 is in the open position as shown in broken lines in FIG. 5, the interior of the tray 34 is accessible, and the child may deposit water, sand, clay, or substantially any desired materials therein for playing, or the like. The sides of the tray 34 substantially preclude accidental discharge of the contents thereof from the interior of the tray during a child's play period. Not only can the tray 34 be utilized for play periods, but also, a child may use the tray for holding food, and the like, while eating. For example, the apparatus 10 may be utilized by the child for eating while watching television, or the like, and greatly reduces the accidental depositing of food on the floor.

With the backboard 42 installed on the box 14 as shown in FIG. 1, many hours of diversified amusement may be provided for the user of the apparatus 10. For example, the tray 34 may be filled with a suitable quantity of water whereby any or all of the boats 56 may be placed on the surface of the water for floating therein. The rotor or fan 58 may then be activated in the usual manner (not shown), and the movement of air supplied thereby across the length of the open end of the tray 34 will be sufficient for propelling the boats across the surface of the water. It is anticipated that a second fan or rotor (not shown) may be provided at the opposite side of the box 14 and offset with respect to the fan 58 for moving air in an opposite direction than the fan 58 in order that the boats may be propelled in opposite directions along the surface of the water.

Alternately, the water in the tray 34 may be utilized by the child for activating or propelling the amusement devices 46, 48, 50 and 52. For example, the device 46 as shown in FIG. 1 comprises a funnel member 66 having an open end 68 in communication with the outer periphery of a rotatable water wheel 70, and in further communication with a channel member 72. The member 72 is in communication with a container 74 having the lower end thereof open to the interior of the tray 34. Thus, when water is deposited within the funnel 66, it will move or flow by gravity over the water wheel 68, turning the wheel 68, and flow downwardly through the channel 72 and container 74 for discharge into the water supply within the tray 34.

The device 48 as shown in FIG. 1 comprises a container 76 constructed of a suitable transparent plastic material, or the like, and having a relatively wide open upper end 78 and a restricted opening 80 at the lower end thereof in open communication with the interior of the tray 34. In addition, relatively light weight elements 82, which may be in the form of fishes or the like, are deposited in the container 76. The child may fill the container 76 with water from the water supply in the tray 34, and as the water accumulates within the container 76, the elements 82 will float and "bob" around in the water to provide amusing action in the container 76 for the observer. Of course, the water flows out of the container 76 through the restricted opening 80 for reentry into the water supply within the tray 34, and the movement of the water moving longitudinally through the container 76 creates a continuous activity for the elements 82.

The device 50 as shown in FIG. 1 comprises an open funnel member 84 terminating in an open tubing element 86 of a tortuous configuration and open at the lower end thereof for communication with the interior of the tray 34. It is preferable that the funnel 84 and tubing 86 be constructed of a suitable transparent plastic material of a variegated color arrangement. The child using the apparatus 10 may deposit water from the tray 34 into the open funnel 84, and the water will travel downwardly by gravity through the tubing 86 and discharge into the tray 84. As the water travels through the variegated colored tubing, the water appears to change color, to provide an intriguing pastime for the user of the apparatus.

The device 52 as shown in FIG. 1 comprises a hollow, transparent body 88 of any suitable configuration. The lower end of the body 88 terminates in an elongated tubular element 90 having the outer end thereof open and extending beneath the surface of the water disposed in the tray 34. The upper end of the body 88 is open to a yieldable bulb member 92 whereby contraction and expansion of the bulb by the hand of the child will draw water from the tray 34 through suction into the interior of the body 88, from whence it will run back out through the tube 90 for return to the water supply in the tray 34.

Other toys (not shown), books (not shown), or the like, as well as the backboard 42 and devices secured thereto, may be stored on the shelves 22, if desired, when not in use, thus adding to the general utility of the apparatus 10. It will be apparent that the child's seat 10 not only provides an attractive, utilitarian play area for a child, but also provides an area wherein a great collection of the child's toys, books, and the like, may be stored for convenience and efficiency.

Whereas the present invention has been described in particular relation to the drawings attached hereto, it should be understood that other and further modifications, apart from those shown or suggested herein, may be made within the spirit and scope of this invention.

What is claimed is:

1. A child's play seat apparatus comprising support frame means, box-like play area means carried at one end of the support frame means and having the upper side thereof open, tray means disposed in said play area means and insertable and removable through said open upper side of said play area means, and seat means secured to the support frame means and disposed in spaced relation to the play area means for supporting a child using the seat apparatus, wherein the support frame means comprises a pair of spaced upstanding wall members having a box-like play area secured at the upper end thereof, with said seat means secured to one of said wall members and extending outwardly therefrom, wherein the seat means comprises support arm means having one end secured to the outer surface of said one wall member and extending outwardly therefrom, and a straddle-type seat member secured to the opposite end of the support arm.

2. A child's play seat apparatus comprising support frame means, box-like play area means carried at one end of the support frame means and having the upper side thereof open, tray means disposed in said play area means and insertable and removable through said open upper side of said play area means, seat means secured to the support frame means and disposed in spaced relation to the play area means for supporting a child using the seat apparatus, backboard means secured to the box-like play area means in the proximity of the removable tray means, amusement device means carried by the backboard means and cooperating with the tray means to provide diversified amusement for the child, the amusement device means including a plurality of individual devices in communication with and cooperating with the tray means for providing amusement for the child, and blower means secured to the box-like play area means for directing a stream of air across the open end thereof at the selection of the child for facilitating amusement through use of the apparatus.

3. A child's play seat apparatus comprising support frame means, box-like play area means carried at one end of the support frame means and having the upper side thereof open, tray means disposed in said play area means and insertable and removable through said open upper side of said play area means, seat means secured to the support frames means and disposed in spaced relation to the play area means for supporting a child using the seat apparatus, backboard means secured to the box-like play area means in the proximity of the removable tray means, amusement device means carried by the backboard means and cooperating with the tray means to provide diversified amusement for the child, and wherein the amusement device means includes a funnel means in open communication with water wheel means whereby water injected into the funnel means falls by gravity over the water wheel means for actuation thereof and subsequently into the tray means.

4. A child's play seat apparatus comprising support frame means, box-like play area means carried at one end of the support frame means and having the upper side thereof open, tray means disposed in said play area means and insertable and removable through said open upper side of said play area means, seat means secured to the support frame means and disposed in spaced relation to the play area means for supporting a child using the seat apparatus, backboard means secured to the box-like play area means in the proximity of the removable tray means, amusement device means carried by the backboard means and cooperating with the tray means to provide diversified amusement for the child, wherein the amusement device means includes container means having the upper end thereof provided with a relatively wide opening for receiving fluid therethrough and the lower end thereof provided with a restricted opening for discharging fluid therethrough, and independent lightweight elements loosely disposed within said container for agitation therein while the fluid is moving therethrough, said fluid being discharged into the tray through said restricted opening in said container.

5. A child's play seat apparatus comprising support frame means, box-like play area means carried at one end of the support frame means and having the upper side thereof open, tray means disposed in said play area means and insertable and removable through said open upper side of said play area means, seat means secured to the support frame means and disposed in spaced relation to the play area means for supporting a child using the seat apparatus, backboard means secured to the box-like play area means in the proximity of the removable tray means, amusement device means carried by the backboard means and cooperating with the tray means to provide diversified amusement for the child, wherein the amusement device means includes funnel means secured on the backboard for receiving fluid therein, and tubular means of a tortuous configuration in communication with the funnel means and tray means for delivering fluid from the funnel means into the tray means.

6. A child's play seat apparatus comprisng support frame means, box-like play area means carried at one end of the support frame means and having the upper side thereof open, tray means disposed in said play area means and insertable and removable through said open upper side of said play area means, seat means secured to the support frame means and disposed in spaced relation to the play area means for supporting a child using the seat apparatus, backboard means secured to the box-like play area means in the proximity of the removable tray means, amusement device means carried by the backboard means and cooperating with the tray means to provide diversified amusement for the child, and wherein the amusement device means includes container means constructed from a transparent material, yieldable bulb means secured to one end of said container means and in communication with the interior thereof, elongated tube means in communication with the interior of the container means oppositely disposed with respect to the bulb means and extending into the interior of the tray means whereby fluid disposed within the tray means will be drawn into the interior of said container means upon flexing of said bulb means.

* * * * *